US005927209A

United States Patent [19]

Cotsford

[11] Patent Number: 5,927,209

[45] Date of Patent: Jul. 27, 1999

[54] RAIL HEATING AND CLIP APPLICATOR

[75] Inventor: Stephen G. Cotsford, Columbia, S.C.

[73] Assignee: Harsco Corporation, Camp Hill, Pa.

[21] Appl. No.: 08/839,460

[22] Filed: Apr. 14, 1997

[51] Int. Cl.[6] ..... E01B 29/00

[52] U.S. Cl. ..... 104/2; 104/17.2

[58] Field of Search ..... 104/2, 7.1, 17.2

[56] References Cited

U.S. PATENT DOCUMENTS

| | | | |
|---|---|---|---|
| 399,276 | 12/1889 | Brown et al. | 104/2 |
| 3,117,530 | 1/1964 | Miller | 104/2 |
| 3,680,486 | 8/1972 | Plasser et al. | 104/12 |
| 3,766,860 | 10/1973 | McIlrath . | |
| 3,841,221 | 10/1974 | Dieringer et al. . | |
| 4,211,170 | 7/1980 | Theurer | 104/2 |
| 4,319,392 | 3/1982 | Cutts | 29/402.8 |
| 4,471,526 | 9/1984 | Zaltsberg | 29/745 |
| 4,494,463 | 1/1985 | Young et al. . | |
| 4,669,387 | 6/1987 | Casarini et al. | 104/17.2 |
| 4,726,107 | 2/1988 | Knudson | 29/243.5 |
| 4,903,611 | 2/1990 | Holley | 104/307 |
| 4,918,797 | 4/1990 | Watkins et al. | 29/243.5 |
| 5,003,888 | 4/1991 | Martin | 104/17.2 |
| 5,146,677 | 9/1992 | Holman et al. | 29/243.5 |
| 5,181,472 | 1/1993 | Scheuchzer | 104/2 |
| 5,237,143 | 8/1993 | Scheuchzer | 104/2 |
| 5,269,225 | 12/1993 | Bosshart et al. | 104/2 |
| 5,299,504 | 4/1994 | Abele | 104/2 |
| 5,584,247 | 12/1996 | Almaraz et al. | 104/2 |

FOREIGN PATENT DOCUMENTS

| | | |
|---|---|---|
| 2348014 | 5/1974 | Germany . |
| 1540868 | 2/1979 | United Kingdom . |
| 2102863 | 2/1983 | United Kingdom . |

*Primary Examiner*—S. Joseph Morano
*Attorney, Agent, or Firm*—Eckert Seamans Cherin & Mellott, LLC

[57] ABSTRACT

A track renewal machine and method provides for the fastening of rails to cross ties without any requirement for secondary destressing. Heat is applied to the rails and the clips are then fastened to secure the rails to the cross ties. The rails are heated with one end unconstrained, the heat being applied to the rails essentially simultaneously with the application of clips and insulators to the rail.

11 Claims, 6 Drawing Sheets

RAIL HEATING AND CLIP APPLICATOR

FIELD OF THE INVENTION

The invention relates to railroad track construction, and more particularly to that portion of the railroad track construction process utilizing the heating of rails and attachment of rail clips.

BACKGROUND OF THE INVENTION

During railroad track construction, as well as major renewal of an existing railroad track, the track structure must be installed such that subsequent temperature variations or other weather conditions will not cause the rails to come loose or otherwise become unsafe. As a consequence, it is often necessary to carry out an operation on the rails referred to as "destressing." The destressing operation includes releasing rail fasteners, holding the rails to cross ties at a specific section of track, and heating or pulling the rails. Destressing the rails creates a finished track condition that is more capable of withstanding extreme temperature variations without the risk of deformation due to expansion and contraction of the rails.

Performing a destressing operation subsequent to the laying of the rails typically requires several additional steps in the railroad track construction process, as well as, additional specialized machinery. For example, U.S. Pat. No. : 4,903,611, issued to Holley on Feb. 27, 1990; U.S. Pat. No. 5,146,677, issued to Holman et al. on Sep. 15, 1992; and U.S. Pat. No. 5,269,225, issued to Bosshart et al. on Dec. 14, 1993, each disclose various machines and methods for performing a secondary destressing operation during railroad track construction or renewal. More particularly, the Holley patent shows an anchor spreader apparatus and method for using it with tie gangs, the Holman patent discloses a rail anchor remover mounted on a crane, and the Bosshart patent shows an apparatus and method for applying rail clips and insulators.

None of the prior art devices or methods have been found to be completely satisfactory. In particular, there has long been a need for a railroad track construction machine that is capable of laying or renewing rail without the need for a secondary destressing operation.

SUMMARY OF THE INVENTION

The present invention provides a track construction machine having a frame structure, a rail heater mounted to the frame structure, and a clip applicator mounted to the frame structure. The clip applicator is operable to initially clip rails to cross ties when the rails are still at a predetermined temperature following heating by the rail heater. As used herein, "initially clip rails" refers to rails, either new or reused, being clipped to cross ties initially, as opposed to a secondary destressing operation where the rails are clipped by fasteners, then later released from the fasteners, for heating and then resecuring.

The rail heater includes a heater device having front and back wheels that ride on rails, with the heater device being movably mounted to the frame structure. The rail heater has an operator seat at one end. The operator seat is disposed under the frame structure. The heater device is connected to the structural frame by way of a support arm pivotably connected at one end to the heater device and pivotably connected at another end to the structural frame. The track construction machine further includes a rail temperature sensor coupled in a feedback loop to control the rail heater based on the sensed temperature. The frame structure includes a first main frame and a second main frame and a bogie disposed between the first and second main frames, mounted to at least one of the first and second main frames. Preferably, the rail heater is mounted to the first main frame and the clip applicator is mounted to the second main frame. The bogie is preferably mounted to the first main frame. The clip applicator includes an applicator frame that is movably connected to the second main frame so that the applicator frame may move relative to the second frame along the railroad track. Means are provided for moving the clip applicator longitudinally relative to the frame structure and in a rail direction. In this way, as the second main frame moves along the railroad track the clip applicator may remain in a first stationary position for a period of time necessary for the clips to be applied to the rails. Once the clips are in place on the rails, the clip applicator frame is moved forwardly by the moving means and relative to the second frame, so as to reposition the clip applicator at the next succeeding position along the track for application of clips. The clips are applied by (i) at least one hydraulic cylinder that is movably mounted to the second frame, e.g., by rollers, and is operable to push downwardly against the clip applicator, and (ii) a clip clamp that is operable to fasten the clips such that the rails are fastened to cross ties.

The method of the present invention is a method of track construction. The steps include: heating a rail using a rail heater prior to initial fastening of it to cross ties, the rail being free to expand on one end and clipping the rail to cross ties by use of a clip applicator when the rail is still at a predetermined temperature resulting from heating by the rail heater. The method of track construction is such that no secondary destressing operation is required. The rail heating step may include the substeps of sensing a rail temperature, comparing the sensed temperature to a predetermined reference temperature value, and adjusting the rail heater to bring the rail temperature closer to the reference temperature. The method of track construction further includes: after the rail heating, but before the clipping, passing a bogie over the rail. The method of track construction further includes: after the rail heating, but before passing the bogie over the rail, guiding the rail into rail seats on cross ties. The clip applicator is pressed downwardly onto the rail by using at least one hydraulic cylinder to press on the clip applicator. A further step may include, after the rail heating, but before the clipping of the rail, guiding the rail into rail seats on the cross ties of the railroad track.

BRIEF DESCRIPTION OF THE DRAWINGS

The above and other features of the present invention will be more readily understood when the following detailed description is considered in conjunction with the accompanying drawings wherein the same reference numbers identify the same parts throughout the several views. In the drawings.

DETAILED DESCRIPTION OF THE PREFERRED EMBODIMENT

Figure 1:
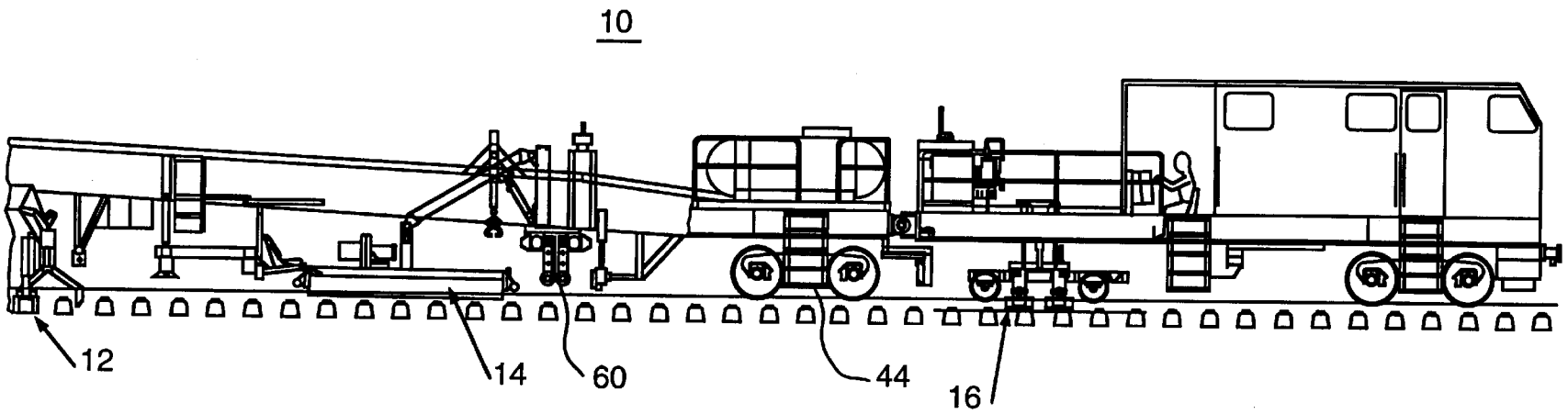
FIG. 1 is a side elevational view of a portion of a work train incorporating a rail heating and clip applicator formed in accordance with the present invention.

Referring first to FIG. 1, a work train 10 includes a conventional beam car having a cross tie or sleeper layer 12, a rail heater assembly 14, and a trailer car having a clip applicator 16. An old cross tie or sleeper pickup machine (not shown) and a ballast spreader (not shown) may be operated ahead of the new cross tie or sleeper layer machine 12 in a working direction. Other than the rail heater assembly 14 and clip applicator 16, which are aspect(s) of the present application, the mechanisms not shown in FIG. 1 need not be described in detail. However, it should be noted that the work train may include, ahead of sleeper layer machine 12, a track renewal machine (not shown) of the type described in a co-pending application entitled RAIL ANCHOR REMOVAL by the inventor herein, filed Apr. 9, 1997, Ser. No. 08/826,896, and hereby incorporated by reference.

Figure 2:
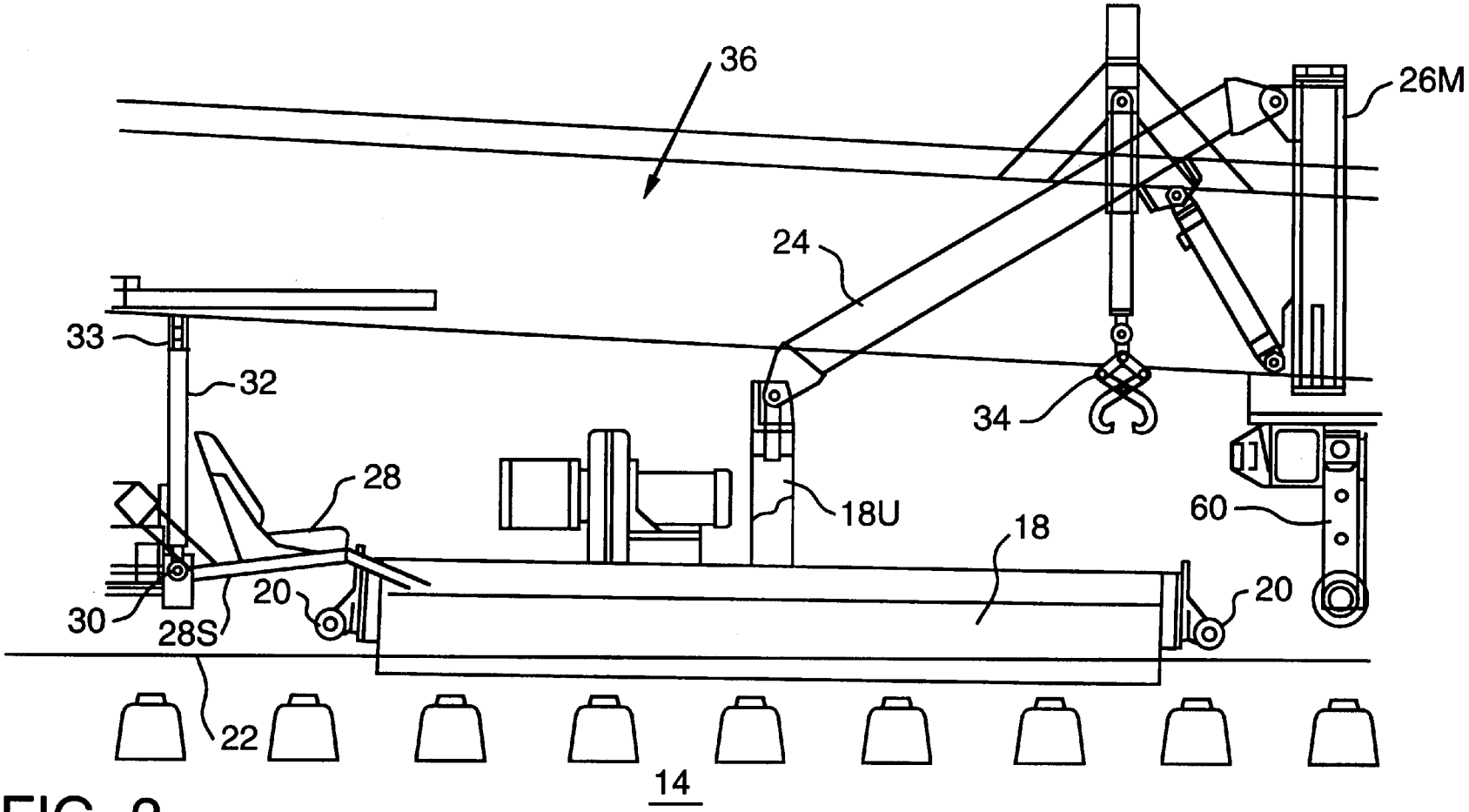
FIG. 2 is a side view of the rail heater shown in FIG. 1.

Referring to FIG. 2, rail heater assembly 14 comprises rail heater devices 18. One is visible in FIG. 2, but there are preferably right and left heater devices, one for the right rail and one for the left rail in a fully operative work train 10 embodying a preferred form of the present invention. Each rail heater device 18 includes a front and a back wheel 20 allowing it to roll on rail 22. Rail heater devices 18 have upright members 18U pivotably connected to heater support arms 24. Heater support arms 24, in turn, include upper ends pivotably connected to members 26M of frame 36. A centrally located seat 28 is disposed between and ahead of rail heater devices 18. Seat 28 includes a support 28S pivotably connected at point 30 to post 32. Post 32 has an upper end 33 that is pivotably connected to frame 36. Rail heater devices 18 and seat 28 may be moved from the illustrated operational position of FIG. 2 to an upper (not shown) travel position by pivoting at the upper ends of members 24 and 32. Specifically, one or more hydraulic cylinders (not shown) extending from rail heater devices 18 to frame 26, or the hoist 34, may be used to lift rail heater devices 18 into a travel position.

Figure 3:
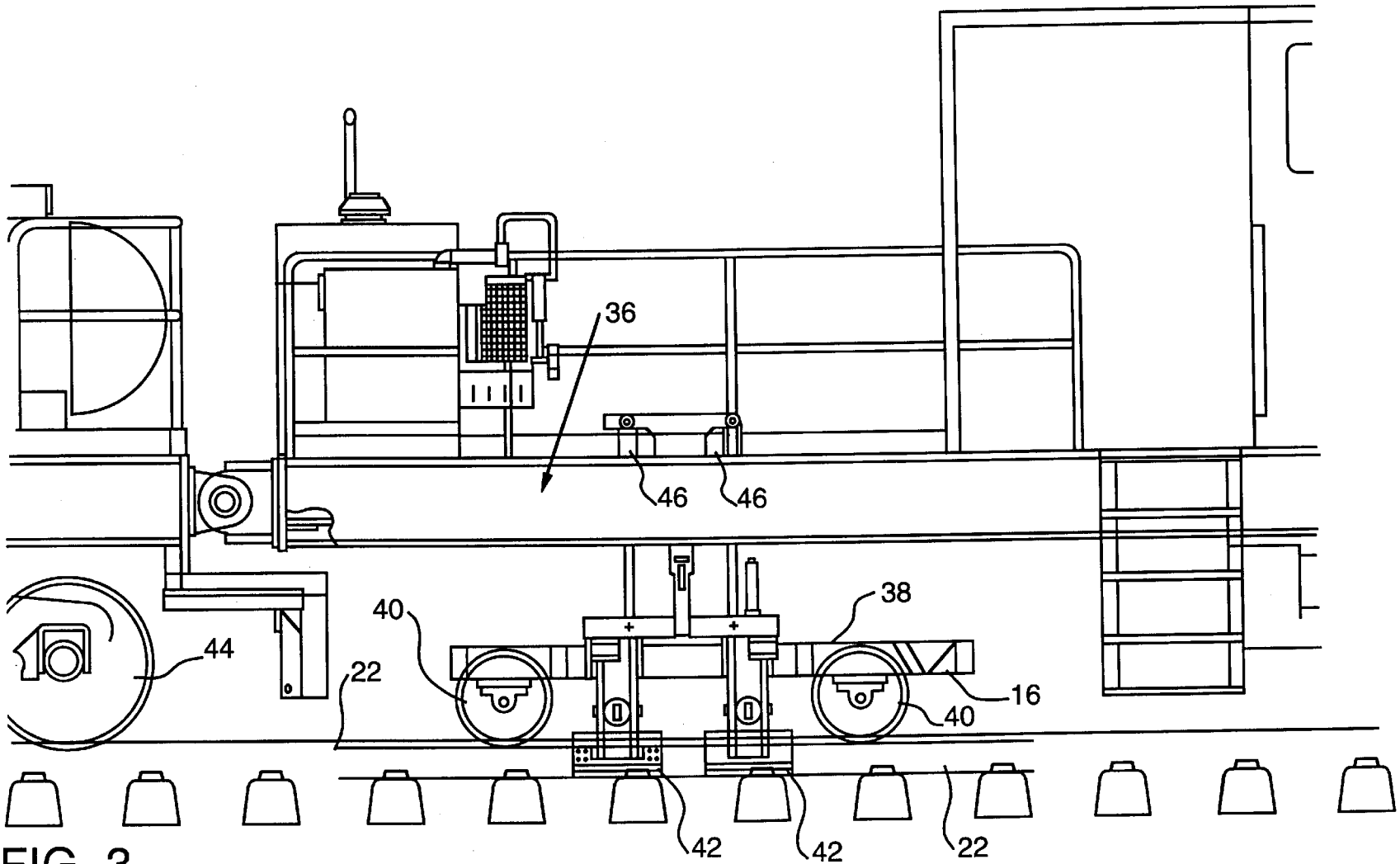
FIG. 3 is a side view of the clip applicator shown in FIG. 1.
Figure 5:
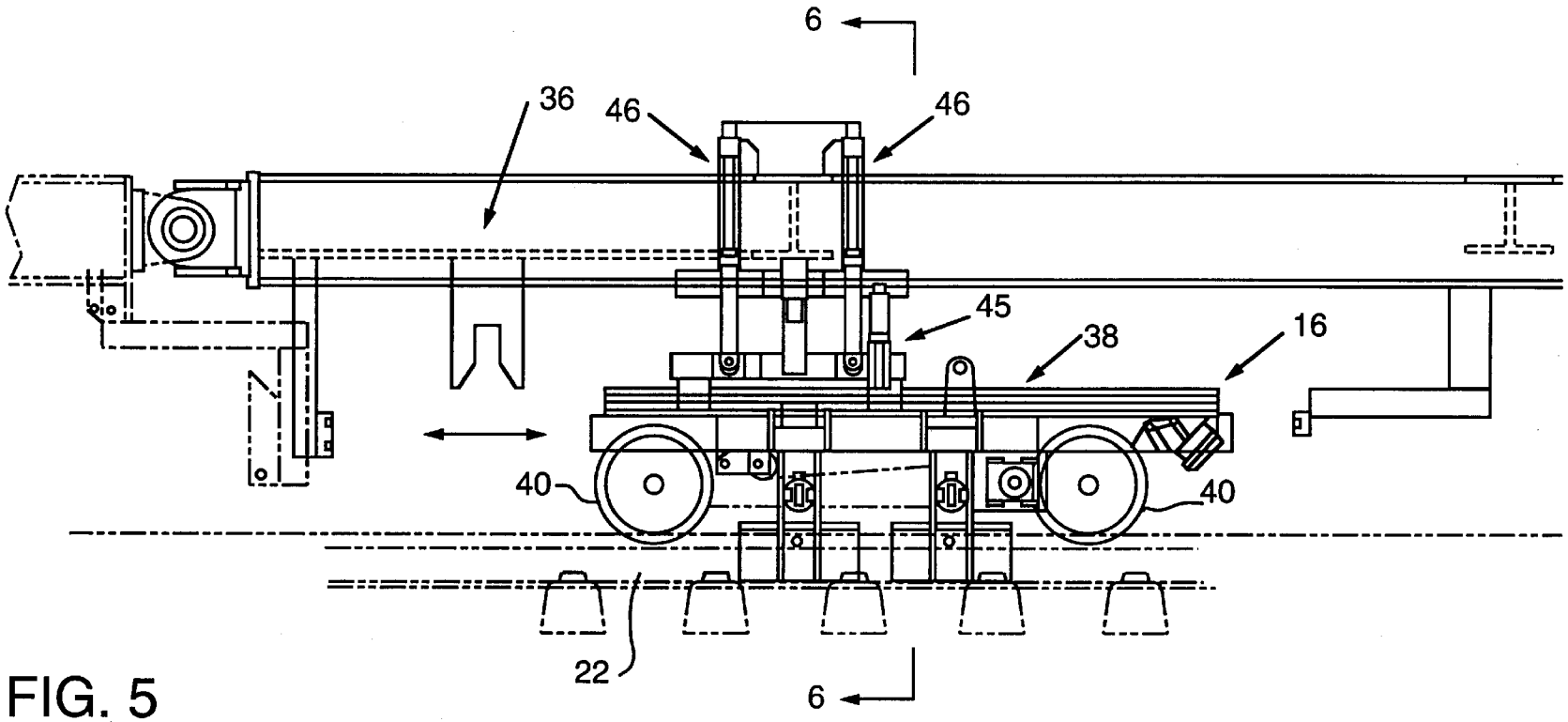
FIG. 5 is a side view of the clip applicator shown in FIG. 3 with portions of the work train removed for clarity of illustration.
Figure 6:
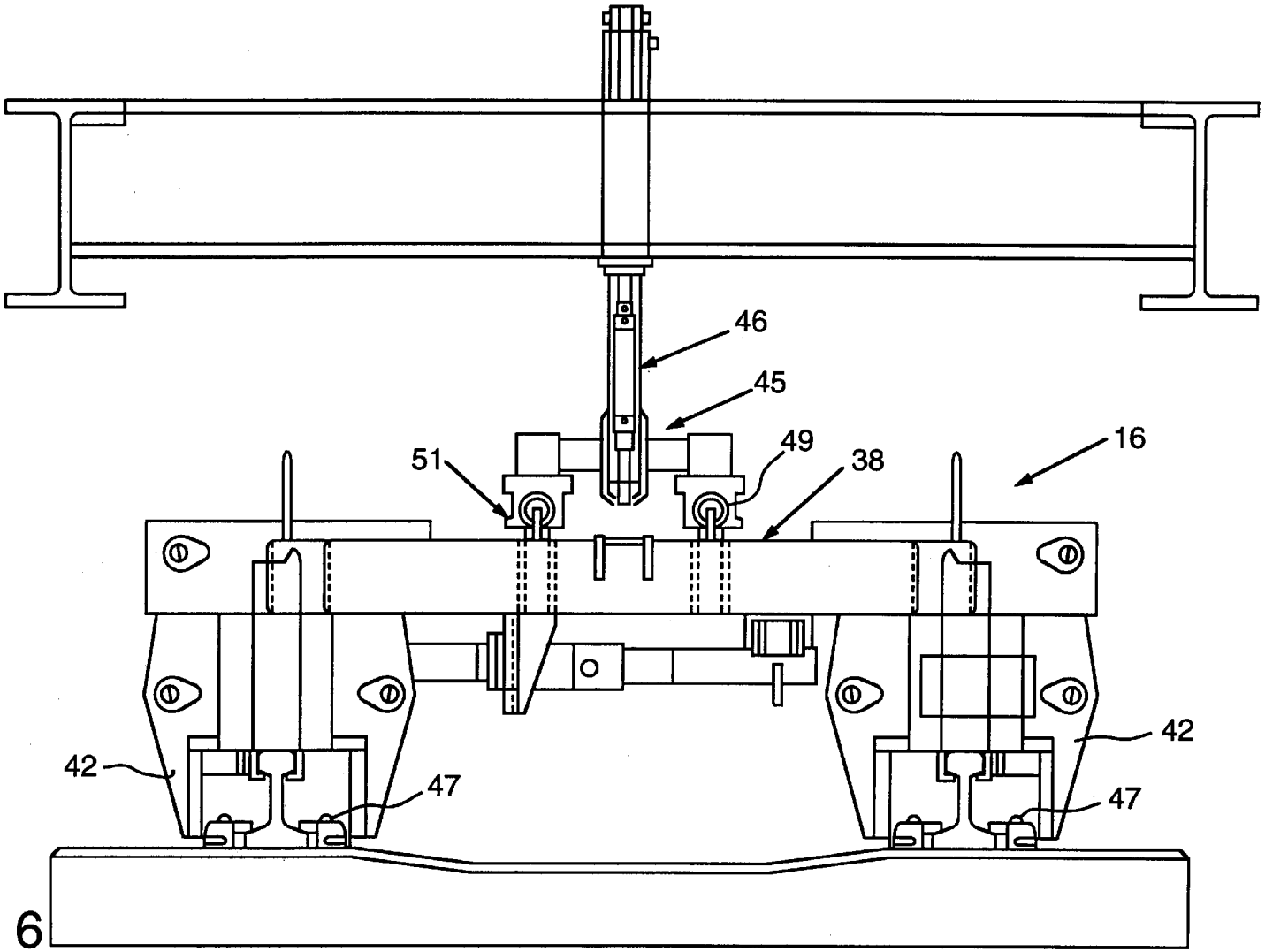
FIG. 6 is an end-on view of the clip applicator shown in FIG. 5, as taken along lines 6—6 in FIG. 5.

Turning to FIGS. 3, 5, and 6, clip applicator 16 is movably mounted on the underside of frame 36 so as to be disposed in confronting relation to rails 22. Clip applicator 16 includes an applicator frame 38, clamps 42, roller assembly 45, and hydraulic cylinders 46. More particularly, wheels 40 are mounted to applicator frame 38 in a conventional manner for rolling engagement with rails 22. At least two clamps 42 are laterally disposed on the underside of applicator frame 38, between wheels 40, and are adapted to attach fasteners or clips 47 to rails 22 just after the bogie 44 has rolled over the rails (FIGS. 1 and 6).

Referring to FIGS. 5 and 6, hydraulic cylinders 46 are securely fastened at one end to frame 36 and at the other end to roller assembly 45. Hydraulic cylinders 46 are of a conventional type that are well known in the art. Roller assembly 45 is movably fastened to the upperside of applicator frame 38 so as to be disposed in confronting relation to frame 36. Roller assembly 45 comprises a plurality of rollers 49 disposed in rolling engagement with corresponding rails 51 that are securely fastened to the upperside of applicator frame 38. As a result of this construction, when hydraulic cylinders 46 are actuated so as to press downwardly against applicator frame 38, rollers 49 roll along rails 51, thereby allowing applicator frame 38 to remain stationary relative to frame 36, for the period of time necessary for clamps 42 to affix clips 47 to rails 22, as will hereinafter be disclosed in further detail. Means for moving clip applicator 16 longitudinally relative to frame 36, and in a rail direction, are provided. For example, such moving means may comprise motorized or hydraulic jacks or cylinders, a chain and pulley system, a flexible transmission link, etc. Preferably, clip applicator 16 is moved along rails 22, both to and from its stationary positions, by means of hydraulics.

Figure 4:
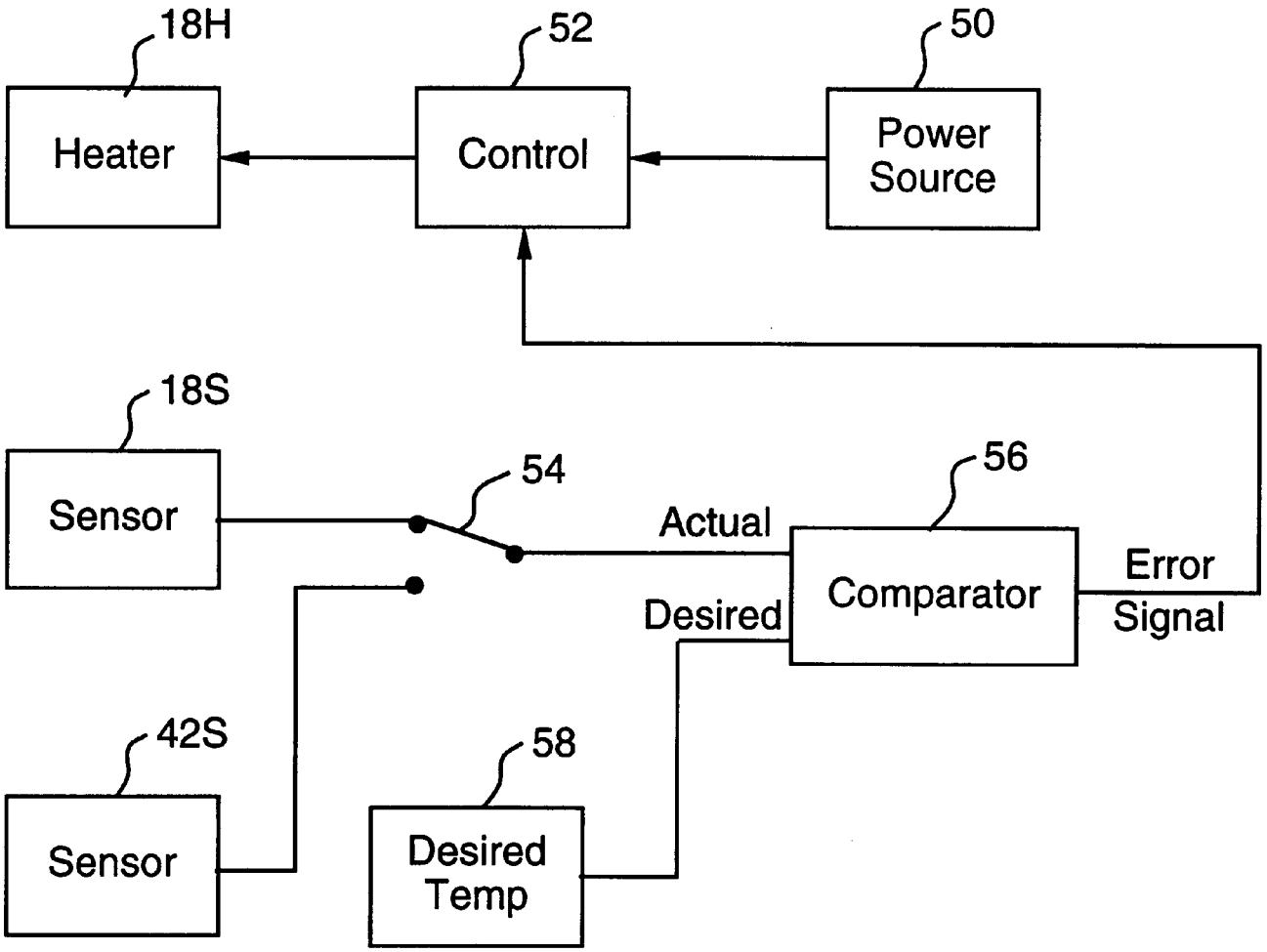
FIG. 4 is a schematic diagram representing a feedback arrangement used in connection with the present invention.

Referring to FIG. 4, a feedback control strategy for the present invention will be briefly described. Each heater(s) 18H disposed within rail heater devices 18 (FIG. 2) is supplied power from a source 50 via control 52. An optional switch 54 selectively allows a temperature signal from a temperature sensor 18S, within or adjacent to rail heater device 18 or a temperature signal from a temperature sensor 42S within or immediately adjacent to clamps 42 (FIG. 3) to pass through to a comparator 56. If desired, only one of sensors 18S or 42S might be used and switch 54 would not be required. In any event, a signal representing the sensed temperature of each rail 22 is compared by comparator 56 with a signal value from block 58 representing a predetermined reference temperature.

It will be appreciated by those skilled in the art that the predetermined reference temperature is selected based upon the geographic location of the railroad track, the temperature extremes likely to be met at that location, and the material characteristics of the rails. It will also be appreciated that comparator 56 may comprise a user adjustable resistor or similar control to set a voltage or current corresponding to a desired temperature.

Still referring to FIG. 4, comparator 56 operates in known fashion to output an error signal to control 52 in order to increase or decrease the heat from heater 18H depending on whether the sensed actual temperature of rails 22 is too high or too low relative to the predetermined temperature. Of course, if the actual temperature is within an acceptable range of the desired, predetermined temperature, the error signal would be zero and heater 18H would not have its level of operation changed. If desired, separate feedback loops corresponding to right and left rails 22 can be used for controlling the right and left heaters 18H by way of separate right and left sensors 18S and 42S. Alternately, the right and left sensors can have their signals averaged to control both right and left heaters 18H. The importance of using this feedback arrangement for the clip applicator will be discussed below.

Unlike prior art railroad track construction machines, the present invention allows one to avoid the need to perform a separate destressing operation. For example, new rail or reused rail (such as rail that has been moved for replacing ties) can be initially clipped in place when its temperature is correct, without the need for subsequently releasing the clips from the rails for heating and then resecuring the clips to the rails.

More particularly, during the track renewal or construction process, reused or new rails are guided by threaders 60 (FIGS. 1 and 2) toward rail seats located in the new cross ties. Forward of this point, the rails are disposed above the cross ties and are heated by the right and left heating devices 18, which apply heat to both the field and gauge sides of the rails.

The heat is applied with sufficient intensity that the rails are brought substantially to the desired temperature regardless of their initial temperature. Additionally, the final temperature (i.e., the predetermined temperature at which the clips are fastened) is controlled via the feedback loop control strategy disclosed above. This feedback control is performed in a continuous manner during the moving operation of railroad track construction machine 10. Alternatively, depending on the precision required for a given rail installation, rail heater devices 18 may simply put out a given amount of heat and the temperature of the rails may be sufficiently determined thereby that no feedback arrangement is required. Generally, however, a feedback arrangement is preferred. In either case, it will be appreciated that, due to the heating, the rails are free to expand, causing displacement toward one end, since they are not yet installed into the railroad track structure.

The heated rails are guided by threaders 60 into position on the rail seats of the cross ties and the weight of the machine, carried by bogie 44, is applied to the rails as bogie 44 runs over the rails. Advantageously, the combined weight of railroad track construction machine 10, the cross ties themselves, and the friction between the cross ties and the track bed contribute to the longitudinal stabilization of the railroad track. Of course, ballast may be added in known fashion to create a finished track in the desired state.

With reference to FIGS. 1, 2, and 3, immediately after rail heater assembly 14 has passed over rails 22 and has heated rails 22 to the predetermined temperature, i.e., while the temperature of the rails is still dependent upon the heat applied to them and before the rails have cooled to ambient temperature, clip applicator 16 applies clips to the rails.

More particularly, clip applicator 16 is an integral part of the railroad track construction machine 10. Proper positioning of rails 22 in the rail seats is assured by the downwardly directed force applied to applicator frame 38 during the actuation of hydraulic cylinders 46 (FIGS. 3, 5, and 6). Advantageously, as a result of the rolling engagement of roller assembly 45 with applicator frame 38, clip applicator 16 may remain in place at the position where clips 47 are being applied to rails 22, while at the same time, work train 10 continues to move forwardly along the track.

Once clips 47 have been applied to rails 22, hydraulic cylinders 46 can be deactivated, thereby releasing the downward pressure on applicator frame 38 so that clip applicator 16 may be moved forwardly, relative to frame 36, so as to be positioned at the next location where clips 47 will be applied to rails 22. Clip applicator 16 is moved in a rail direction, relative to frame 36, via moving means such as hydraulic or electric motive devices that are operatively mounted between frame 36 and a front or rear portion of applicator frame 38. Thus, a portion of the railroad track construction machine's weight is used to hold the rails in place while clips or fasteners 47 are put in place, but without necessitating the stopping of the work train's forward progress along the railroad track.

It will be understood that clips or fasteners 47 clamp the rails to the cross ties or sleepers while the rails are substantially at the predetermined temperature. In this way, it is not necessary to perform the prior art destressing operation. It will be appreciated that clips or fasteners 47 may be the PANDROL type having preassembled insulators or clips that are preassembled on ties.

Elimination of a destressing operation as a secondary process, following initial fastening of the new or reused rails, results in significant cost savings due to lowered requirements for manpower and equipment. The invention also allows track renewal or construction to be completed more quickly than with previous techniques such that a new or renewed track can handle regular train traffic sooner than with prior art processes.

ADVANTAGES OF THE INVENTION

A primary advantage of the invention is the provision of a new and improved technique of initially installing a rail (either new or reused) upon ties.

A more specific advantage of the invention is allowing for initially installing a rail (either new or reused) upon ties in such a fashion that secondary destressing is not required.

Another advantage of the invention is faster rail installation.

A still further advantage of the invention is faster rail installation with reduced expenses, manpower, and machinery than usually used with prior art devices.

Although specific constructions have been presented herein, it is to be understood that these are for illustrative purposes only. Various modifications and adaptations will be apparent to those skilled in the art. In view of possible modifications, it will be appreciated that the scope of the present invention should be determined by reference to the claims appended hereto.

What is claimed is:

1. A railroad track construction machine comprising:

a frame;

a rail heater mounted to said frame and operable to heat the rails of said railroad track, said rail heater including a heater device with front and back wheels that ride on said rails; and a clip applicator mounted to said frame wherein said clip applicator is operable to clip the rails to the cross ties of the railroad track when the rails are substantially at a predetermined temperature resulting from heating by said rail heater.

2. The railroad track construction machine of claim 1 wherein said rail heater has an operator seat at one end thereof, said operator seat being under said frame.

3. The railroad track construction machine of claim 1 wherein said heater device is connected to said frame by a support arm that is pivotably connected at one end to said heater device and pivotably connected at another end to said frame.

4. The railroad track construction machine of claim 1 further comprising a rail temperature sensor and a feedback loop adapted to control said rail heater based on a sensed temperature.

5. The railroad track construction machine of claim 1 wherein said frame includes a first main frame and a second main frame and a bogie disposed between said first and second main frames, said bogie being mounted to at least one of said first and second main frames, wherein said rail heater is mounted to said first main frame and said clip applicator is mounted to said second main frame.

6. The railroad track construction machine of claim 5 wherein said bogie is mounted to said first main frame and said clip applicator includes an applicator frame connected to said second main frame by at least one hydraulic cylinder operable to push downwardly and a clip clamp operable to fasten clips such that said rails are fastened to cross ties.

7. The railroad track construction machine of claim 6 comprising means for moving said clip applicator in a rail direction relative to said frame between (i) a first stationary position at which said clips are fastened to said rails, and (ii) a succeeding position that is forward of said first stationary position.

8. The railroad track construction machine of claim 1 wherein said clip applicator includes an applicator frame connected to said frame by at least one hydraulic cylinder operable to push downwardly and a clip clamp operable to fasten clips such that rails are fastened to cross ties.

9. A railroad track construction machine comprising:

a frame;

a rail heater mounted to said frame and operable to selectively heat the rails of said railroad track, said rail heater including a heater device with at least two wheels that ride on said rails; and a clip applicator mounted to said frame wherein said clip applicator is operable to clip the rails to the cross ties of the railroad track when the rails are substantially at a predetermined temperature resulting from heating by said rail heater.

10. A railroad track renewal machine comprising:

a frame;

at least one rail heater mounted to said frame so as to be operable to heat the rails of said railroad track to a predetermined temperature, said rail heater including a heater device having means for riding on said rails; and a clip applicator mounted to said frame wherein said clip applicator is operable to clip said rails to the cross ties of said railroad track when said rails are substantially at said predetermined temperature wherein said clip applicator includes an applicator frame connected to said frame by at least one hydraulic cylinder operable to push downwardly and a clip clamp operable to fasten clips such that said rails are fastened to cross ties and further wherein said clip applicator is movable relative to said frame between (i) a stationary position at which said clips are fastened to said rails, and (ii) a succeeding position that is forward of said stationary position.

11. A railroad track construction machine comprising:

a frame;

a rail heater mounted to said frame and operable to heat the rails of said railroad track said rail heater including a heater device having means for moving relative to said frame on said rails; and a clip applicator mounted to said frame wherein said clip applicator is operable to clip the rails to the cross ties of the railroad track when the rails are substantially at a predetermined temperature resulting from heating by said rail heater.

* * * * *

UNITED STATES PATENT AND TRADEMARK OFFICE

CERTIFICATE OF CORRECTION

PATENT NO. : 5,927,209
DATED : July 27, 1999
INVENTOR(S) : Stephen G. Cotsford

It is certified that error appears in the above-identified patent and that said Letters Patent is hereby corrected as shown below:

Title page,
Under "References Cited" the first reference should read as follows:
-- 3,999,276 12/1976 Brown et al. --

Signed and Sealed this

Fourth Day of December, 2001

*Attest:*

Nicholas P. Godici

NICHOLAS P. GODICI
*Acting Director of the United States Patent and Trademark Office*

*Attesting Officer*